United States Patent [19]

Lambrechts

[11] Patent Number: 4,881,385

[45] Date of Patent: Nov. 21, 1989

[54] APPARATUS FOR PROCESSING TEXTILES

[76] Inventor: Frank M. P. Lambrechts, 31, Lange Ridderstraat, 2000 Antwerpen, Belgium

[21] Appl. No.: 173,621

[22] Filed: Mar. 25, 1988

[30] Foreign Application Priority Data

Mar. 26, 1987 [NL] Netherlands ..... 8700715

[51] Int. Cl.[4] ..... D06F 21/02; D06F 37/04; D06F 37/30

[52] U.S. Cl. ..... 68/29; 51/164.1; 68/140; 68/144

[58] Field of Search ..... 68/29, 30, 140, 144; 51/164.1; 134/120; 366/220, 233, 236

[56] References Cited

U.S. PATENT DOCUMENTS

| | | | |
|---|---|---|---|
| 174,747 | 3/1876 | Tarr | 68/30 X |
| 617,405 | 1/1899 | Pett | 68/30 |
| 2,180,225 | 11/1939 | Dewhurst | 68/140 |
| 2,465,632 | 3/1949 | Burns | 51/164.1 |
| 2,884,287 | 4/1959 | Sommer | 68/140 X |
| 3,837,810 | 9/1974 | Richards et al. | 366/236 X |

FOREIGN PATENT DOCUMENTS

| | | | |
|---|---|---|---|
| 3129699 | 2/1983 | Fed. Rep. of Germany | 68/29 |
| 1175623 | 12/1959 | France | 51/164.1 |

*Primary Examiner*—Philip R. Coe
*Attorney, Agent, or Firm*—John P. Snyder

[57] ABSTRACT

An apparatus for processing textiles with a mixture of solid bodies and/or liquid, such as stones in a chemical solution or the like, in order for example to achieve a "worn" look, this apparatus being provided with a drum (1) driven for rotation wherein said drum (1) is formed with end walls (4) having a polygonal periphery and abutting number of flat outer wall plates (2) and at least one circular track (8, 9) each of which rolls over at least one pair of wheels (10) supported by a frame (12) so obtaining a rigid and sturdy structure.

5 Claims, 1 Drawing Sheet

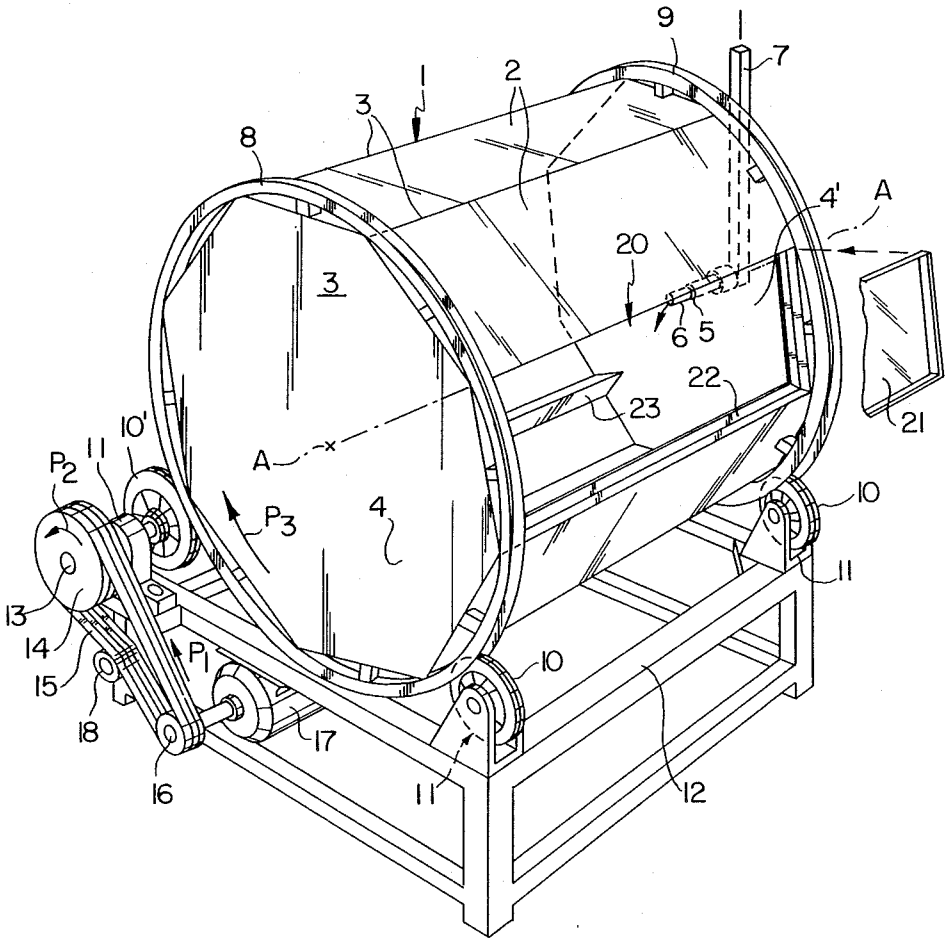
21
A
4'
7
9
2
3
8
5
6
20
22
23
10
11
12
3
4
A
P3
10'
11
P2
13
14
15
18
16
P1
17
10
11

APPARATUS FOR PROCESSING TEXTILES

The invention relates to an apparatus for processing textiles with a mixture of solid bodies and/or liquid, such as stones in a chemical solution or the like, in order for example to achieve a "worn" look, this apparatus being provided with a drum driven for rotation.

It is current practice to give textile goods a worn appearance by "washing" them with a mixture of solid bodies, such as stones, in a liquid, for instance a solution of potasium permanganate, whereby jeans material obtains a worn appearance, this being known in the trade as "stone-washed".

Known machines for stone-washing are provided with a rotatably driven drum, whereby the drum is provided with shaft end parts rotating in bearings, this construction being known for industrial washing machines. Such machines are however prone to damage because the stones with the liquid result in considerable extra weight.

The invention has for its object to provide an apparatus with which stone-washing can be performed in simple manner without this entailing an appreciable weight increase in the construction relative to the known apparatus.

The apparatus according to the invention is distinguished in that the drum is formed with at least one circular track, each of which rolls over at least one pair of wheels supported by a frame.

In the present embodiment the drum itself has a weight that is no greater than in the known devices, but, as a result of the use of the roller track, the drum can be supported much more favourably than with the usual shaft end part construction. The roller tracks can be arranged on the most suitable location of the drum periphery for as favourable a distribution of forces as possible.

One of the supporting wheels or rollers is preferably driven, which results in the construction being even further simplified.

The above mentioned and other features will be further elucidated in the FIGURE description hereinafter of an embodiment that is shown in the annexed drawing.

Designated in the FIGURE with the numeral 1 is a drum which consists of a number of flat sheep-like elements 2, covered with a liner of any suitable material and joined to one another at their longitudinal edges 3, which can be carried out either by bending out of a larger sheet or by welding together of a number of sheets.

The front and rear sides 4 of the drum are closed off by a flat wall which likewise displays a polygonal periphery. Arranged in the rear wall 4' of drum 1 is a central opening 5 into which rums out a connecting end part 6 which connects onto a feed line 7 for a particular liquid, for example a chemical solution.

In accordance with a feature of the invention drum 1 is formed at suitable positions with a circular roller track 8 and 9, which roller track supports in each case on a pair of wheels 10. These wheels are supported for free rotation in bearing frames 11, these bearing frames each forming part of a support frame 12.

The wheel 10' drawn on the front left-hand side is mounted rigidly on a drive shaft 13, which shaft is formed on the front side with a belt pulley 14. Belt pulley 14 co-operates with a belt 15 which is driven by the drive pulley 16 of an electro-motor 17. Belts 15 are tightened in known manner by a tensioning wheel 18.

Drum 1 is formed with an intake and discharge opening 20 which can be closed off by releasable closing plate 21, the peripheral form of which is the same or virtually the same as that of the wall plates 2 of drum 1. The plate 21 is attached in any random manner in a window-like rebate 22, for instance by means of a hinge and/or clamp means. The cover plate 21 can be replaced by a grid or the like, when in the proces it is needed to separate the stones from the textile and/or to feed off the liquid, while retaining the textile in the drum.

For sake of clarity the length of the drum should be ± 150 cm, as is the inner diameter or the roller track.

The above described apparatus operates as follows:

The textile goods for processing, jeans material for instance, are placed in the drum via opening 20, whereby prior to or following this a quantity or solid bodies, for example stones, is added. Fed into the drum via feed line 7, connecting end part 6 and inlet opening 5 is a determined amount of chemical solution, following which the electro-motor can be started. The electro-motor drives belts 15 in the direction of arrow P1 and thereby belt pulley 14 and travel wheel 10' in the direction of arrow P2, as a result of which the drum will revolve in the direction of arrow P3, and preferably within the speed limits of 24–36 rpm. Since the wheels 10 are free turning, the runner track 8 and 9 can run freely over the wheels 10. The content of the drum is revolved round the axis of rotation A—A and will fall back into the drum under the influence of gravity as soon as the angle of fall has been reached. As a result of the continual pounding of the stones on textile goods and the action of the chemical solution, the goods will acquire a different appearance, for instance the desired worn look.

Longitudinal ribs 23 in the drum can thereby improve the transport of the goods, stones and chemical solution in upward direction and therefore make the angle of fall greater.

Drum 1 can be emptied in simple manner by removing the panel 21 in the drawn position, by then revolving the drum further and setting the opening 20 in the undermost position of the drum, after which the processed goods with content drop downward into a discharge container or discharge system (not shown).

The invention is not limited to the above described embodiment. Drum 1 may thus only be provided with one runner track 8, whereby the other end is supported for instance at the inlet opening 5 by a shaft end part.

Runner track 8 can in addition be manufactured from any random material, for example a plastic, or it may be provided with at least a plastic running surface, which contributes to noiseless running of the apparatus.

Driving can be performed in any suitable manner, whereby it is also conceivable that none of the wheels 10 are driven, but that a central shaft end part is provided on the end wall 4 of the drum with a chain wheel for chain driving.

What is claimed is:

1. A stone-washing machine comprising the combination of a rigid, open base frame having opposite sides, a horizontally disposed drum defining a substantially horizontal axis of rotation, said drum having opposite imperforate end walls of regular polygonal shape defining aligned peripheral edges, a plurality of imperforate substantially rectangular panels each of which extends between an aligned pair of said peripheral edges, said panels engaging one another and said end walls to provide a liquid tight drum, one of said panels having at lest a major section which is selectively removable to define an enlarged opening for loading and unloading the drum with solid stone-like objects and textile objects which are to be stone-washed, means for introducing liquid such as potassium permanganate into the drum, support means on said frame for rotatably supporting said drum about said axis, said support means including a pair of spaced coplanar support wheels supported for rotation at one of said sides of the base frame, drive means for rotating said drum about said axis, and guide means on said drum including a circular track circumscribing one end of the drum and rigidly secured thereto, said circular track being of generally outwardly directed U-shaped cross section to define a pair of spaced circular leg portions disposed in substantially parallel planes extending perpendicular to said axis, said support wheels being supported for rotation about axes which are substantially parallel with said first-mentioned axis and having a width fitting into said track, said support wheels having opposite lateral surfaces disposed in facing relation to said leg portions of the associated track to provide means for constraining said drum against axial movement along said axis relative to said frame.

2. A stone-washing machine as defined in claim 1 wherein said guide means also includes a second circular track similar to the first-mentioned circular track and circumscribing the opposite end of the drum and rigidly secured thereto, said support means also including a second pair of spaced, coplanar wheels having widths fitting into said second circular track and supported for rotation on the other of said opposite sides of the frame.

3. A stone-washing machine as defined in claim 2 wherein said drive means is connected to one of said wheels for rotating same.

4. A stone-washing machine as defined in claim 3 wherein said one of said panels is completely removable to form an enlarged opening the size of said one of said panels.

5. A stone-washing machine as defined in claim 4 wherein said means for introducing liquid comprises a conduit passing centrally through one of said end walls and connected to a supply of potassium permanganate.

* * * * *